United States Patent [19]

Moriguchi

[11] 4,143,806

[45] Mar. 13, 1979

[54] CENTRIFUGAL SEPARATOR

[75] Inventor: Masahiro Moriguchi, Yokohama, Japan

[73] Assignee: Mitsubishi Kakoki Kaisha Ltd., Tokyo, Japan

[21] Appl. No.: 850,661

[22] Filed: Nov. 11, 1977

[30] Foreign Application Priority Data

Aug. 30, 1977 [JP] Japan ..... 52/103134

[51] Int. Cl.[2] ..... B04B 1/14

[52] U.S. Cl. ..... 233/20 A

[58] Field of Search ..... 233/20 A, 20 R, 19 R, 233/19 A

[56] References Cited

U.S. PATENT DOCUMENTS

| | | | |
|---|---|---|---|
| 3,494,546 | 2/1970 | Nilson | 233/20 R |
| 3,550,843 | 12/1970 | Hoffmann | 233/20 A |
| 4,044,945 | 8/1977 | Kohlstette et al. | 233/20 A |

FOREIGN PATENT DOCUMENTS

| | | | |
|---|---|---|---|
| 1182602 | 11/1964 | Fed. Rep. of Germany | 233/20 R |

*Primary Examiner*—George H. Krizmanich

*Attorney, Agent, or Firm*—Oblon, Fisher, Spivak, McClelland & Maier

[57] ABSTRACT

A centrifugal separator comprises a rotary body having an outlet at the peripheral part and a sliding valve cylinder in a rotary shell of the rotary body and a lower passage of the sliding valve cylinder formed between the bottom of the rotary shell and the sliding valve cylinder and a first functional fluid inlet connected to the lower passage and a conduit which is connected to an inner part of the lower passage of the sliding valve cylinder and which is opened and closed by the movement of a pilot sliding cylinder which is vertically slidably connected under the rotary shell to form an upper passage and a lower passage which are connected to a second functional fluid inlet, and the upper passage is connected to a nozzle.

3 Claims, 5 Drawing Figures

CENTRIFUGAL SEPARATOR

BACKGROUND OF THE INVENTION

1. Field of the Invention

The present invention relates to a partial discharge type centrifugal separator. More particularly, it relates to a centrifugal separator which automatically closes an outlet depending upon the decrease of the components remained in a rotary body under the balance of the centrifugal hydraulic pressure caused by the remained liquid components to the centrifugal hydraulic pressure caused by a functional fluid remained in a lower passage of a sliding valve cylinder. Furthermore, it relates to a centrifugal separator which comprises a passage of a sealing water which is formed below separating discs for feeding the sealing water into the rotary body.

2. Description of the Prior Arts

Various partial discharge type centrifugal separators comprising a rotary body having an outlet at a peripheral part and a sliding valve cylinder in a rotary shell of the rotary body have been proposed. The discharge of the components from the outlet of the rotary body is controlled by sliding the sliding valve cylinder while varying the centrifugal hydraulic pressure in the lower passage of the sliding valve cylinder. The feed of the functional fluid in the lower passage of the sliding valve cylinder is controlled in predetermined timing.

It has been difficult to precisely control the timing so as to discharge the sludge and water and to maintain the oil.

SUMMARY OF THE INVENTION

It is an object of the present invention to provide a centrifugal separator which partially discharges only the specific separated components such as a sludge and water under the balance of the centrifugal hydraulic pressure caused by the components maintained in the rotary body and the centrifugal hydraulic pressure caused by the functional fluid.

It is another object of the present invention to provide a centrifugal separator which partially discharges only the sludge separated from a fuel oil, a lubricating oil, and a dirty oil containing precipitate, etc. while preventing loss of the oil by feeding a sealing water.

It is the other object of the present invention to provide a centrifugal separator which can be modified to the total component discharge type only by removing a cap for a passage for removing the functional fluid in the lower passage of the sliding valve cylinder.

The foregoing and other objects of the present invention have been attained by providing a centrifugal separator which comprises a lower or passage of a sliding valve cylinder which is connected to a first functional fluid inlet; a conduit which is connected to an inner part of the lower passage of the sliding valve cylinder which is opened and closed by the movement of a pilot sliding cylinder which is vertically slidably connected under the rotary shell to form an upper space and a lower passage which are connected to a second functional fluid inlet and the upper passage is connected to a nozzle whereby the centrifugal hydraulic pressure caused by the functional fluid maintained in the outer part of the lower passage of the sliding valve cylinder is contributed to open and to close the outlet for discharging the separated components.

The sealing water is fed to prevent the discharge of the oil from the sludge accumulation part.

BRIEF DESCRIPTION OF THE DRAWINGS

A more complete appreciation of the present invention will be readily obtained by reference to the following detailed description when considered in connection with the following drawings wherein.

DETAILED DESCRIPTION OF THE PREFERRED EMBODIMENTS

Figure 1:
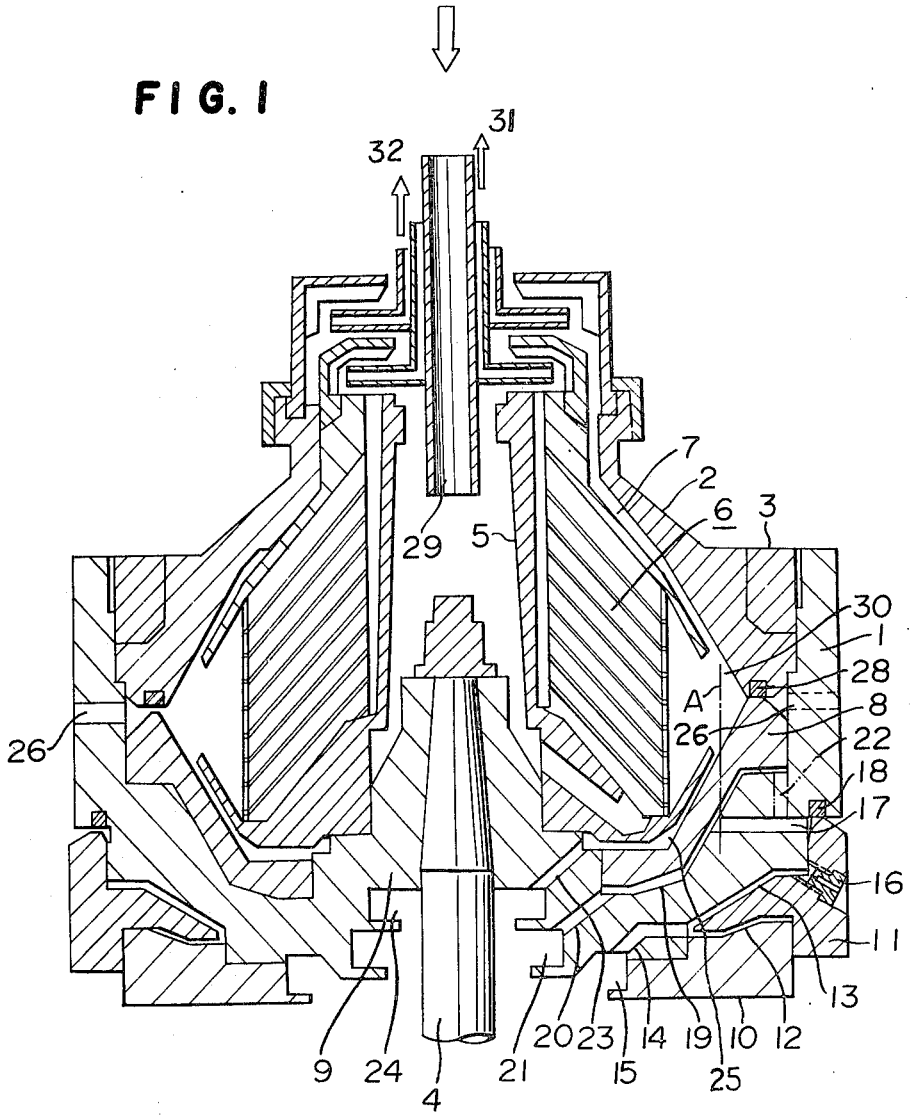
FIG. 1 is a sectional view of one embodiment of a centrifugal separator of the present invention wherein the left side shows the condition opening the valve and the right side shows the condition closing the valve.

Referring to the drawings, wherein like numerals designate identical or corresponding parts throughout the several views. One embodiment of the centrifugal separator according to the present invention will be illustrated.

In FIGS. 1 to 5, the reference numeral (1) designates a rotary shell; (2) designates a cover which is fixed on the rotary shell with a fastening ring (3) so as to form a rotary body of the centrifugal separator. The rotary body having the rotary shell (1) is rotated by a shaft (4) in high speed.

A guide cylinder (5) is disposed at the central part of the rotary body and a plurality of separating discs (6) in bevel form are disposed with a constant gap in a separating chamber formed between the guide cylinder (5) and the cover (2). A plate for guiding water (7) is disposed between the upper separating discs (6) and the cover (2). A sliding cylinder valve (8) is fitted between an inner surface of the rotary shell (1) and a boss (9) so as to be vertically slidable under hydraulic pressure. A rotary ring (10) is fixed on the bottom of the rotary shell (1). A pilot sliding cylinder (11) is fitted between the bottom of the rotary shell (1) and the rotary ring (10) so as to be vertically slidable under centrifugal hydraulic pressure. Both a lower passage (12) of the pilot sliding cylinder and an upper space (13) of the pilot sliding cylinder are connected through a conduit (14) to a functional fluid inlet (15) for opening the sliding valve cylinder. A nozzle for removing water (16) is connected to the upper passage (13) of the pilot sliding cylinder (11) at the outer part. A conduit (17) formed in the rotary shell (1) is opened and closed by the operation of the pilot sliding cylinder (11). A seal ring for pilot sliding cylinder (pilot seal ring) (18) is contacted with the pilot sliding cylinder (11). The conduit (17) is connected through the lower passage (19) of the sliding valve cylinder and the conduit (20) to the inlet (21) of the functional fluid for closing the sliding valve cylinder. A conduit (23) is formed in the boss (9) of the rotary shell (1) and the inner side of the conduit (23) is connected to a sealing water inlet (24) and the outside of the conduit (23) is connected to a sealing water passage (25). An outlet (26) is formed at the outer part of the rotary shell (1). A sealing ring for sliding valve cylinder (valve sealing ring) (28) is contacted with a top of the sliding valve cylinder (8) and a feed tube (29) for feeding a mixture is disposed at a center. The reference numeral (31) designates an outlet of a light liquid (oil) and (32) designates an outlet of a heavy liquid (water).

The operation of the centrifugal separator will be illustrated.

Figure 2:
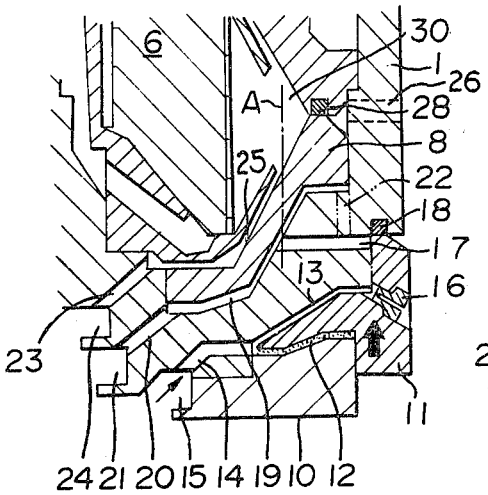
FIGS. 2 to 5 show the movements of a sliding valve cylinder and a pilot sliding cylinder.

1. FIG. 2 shows the condition of closing the conduit (17) by the pilot sliding cylinder (11). The rotary body rotates to reach the predetermined rotational speed. The functional fluid such as water is fed from the functional fluid inlet (15) into the lower passage (12) of the pilot sliding cylinder (11) for several seconds. The functional fluid fed into the upper space (13) is discharged through the nozzle (16). Accordingly, the pilot sliding cylinder (11) is pushed up under the centrifugal hydraulic pressure caused by the functional fluid maintained in the lower space (12) to close the conduit (17) by the pilot sealing ring (18).

Figure 3:
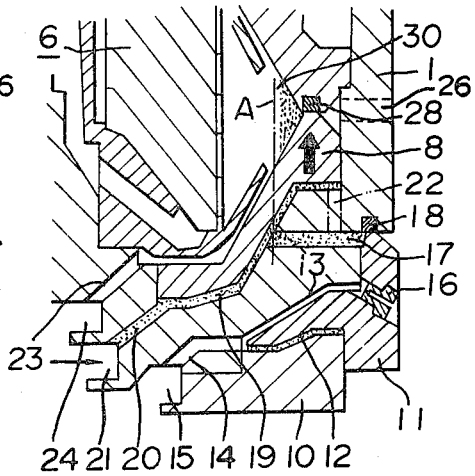

2. FIG. 3 shows the condition of closing the outlet (26) by the sliding cylinder valve (8). The functional fluid is fed from the functional fluid inlet (21) for several seconds. The functional fluid is maintained in the lower space (19) of the sliding valve cylinder whereby the sliding valve cylinder is pushed up under the centrifugal hydraulic pressure to close the outlet (26) by the valve sealing ring (28).

Figure 4:
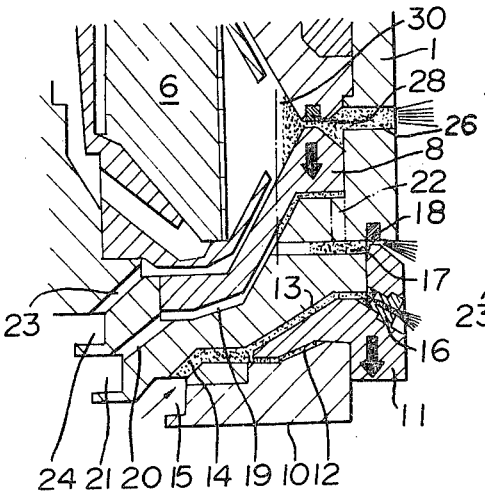

3. FIG. 4 shows the condition of discharging the sludge.

In the condition (2), a predetermined amount of the sealing water is fed from the sealing water inlet (24) whereby the sealing water is fed through the sealing water passage (25) to the sludge accumulating part (30). The mixture (a fuel oil, a lubricating oil and a dirty oil containing precipitate, etc.) is fed through the feed tube (29) to carry out the centrifugal separation in the rotary body. The sludge separated from the slurry into the sludge accumulating part (30) by the centrifugal separation should be discharged.

Figure 5:
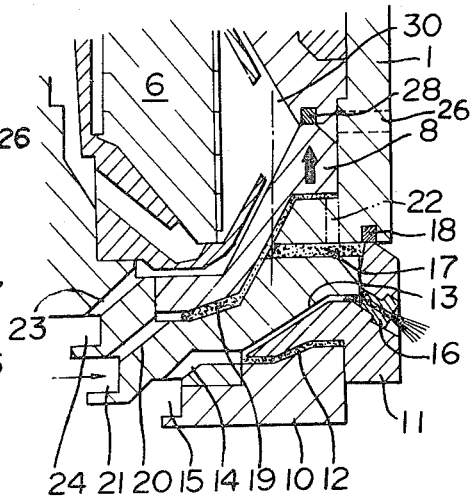

The discharging manner will be illustrated.

a. The functional fluid is fed from the functional fluid inlet (15) at the rate of more than the amount of the functional fluid discharged through the nozzle (16) (the functional fluid is fed at high rate for 0.5 to 10 second) and the functional fluid is maintained in the upper space (13) of the pilot sliding cylinder whereby the pilot sliding cylinder (11) is pushed down to open the conduit (17) by the pilot sealing ring (18) because the centrifugal hydraulic pressure caused by the functional fluid remained in the upper passage (13) is higher than that of the lower passage (12).

b. The functional fluid in the lower passage (19) of the sliding valve cylinder is immediately discharged through the conduit (17) to the level of the chain line A. The functional fluid is maintained in the lower passage (19) at a part outside of the chain line A. Since the centrifugal hydraulic pressure caused by the functional fluid maintained in the outward of the lower passage (19) is lower than the centrifugal hydraulic pressure caused by the total components of the mixture (oil, water and sludge), the sliding valve cylinder (8) is pushed down and the valve sealing ring (28) is opened whereby the sludge and a part of water are discharged from the outlet (26).

c. The mixture is continuously fed during the operation in the condition b). When the amounts of the separated water and sludge discharged from the outlet (26) is more than a feed rate of the mixture, the level of the oil in the rotary body is outwardly shifted for certain time. When the level is shifted for certain distance, the centrifugal hydraulic pressure caused by the total components in the rotary body becomes lower than the centrifugal hydraulic pressure caused by the functional fluid in the outer part of the lower passage (19) of the sliding valve cylinder outward of the chain line A whereby the sliding valve cylinder (8) is pushed up to close the valve sealing ring (28). The pilot sliding cylinder (11) is pushed up while controlling the timing for feeding the functional fluid to close the conduit (17) by the pilot sealing ring (18). The functional fluid is fed from the conduit (20) to completely close the valve sealing ring (28). The condition is shown in FIG. 5.

d. In the operation in the condition (c), the functional fluid is maintained in the outer part of the lower space (19) of the sliding valve cylinder outward of the chain line A whereby the partial discharge can be precisely carried out.

In the embodiment, the timing for feeding the functional fluid into the lower space (19) of the sliding valve cylinder for discharging the sludge, is later than the timing for feeding the functional fluid from the functional fluid inlet (15) for opening the valve. However, it is possible to feed the functional fluid into the lower space (19) at the same time or before feeding the functional fluid from the functional fluid inlet (15).

The partial discharge can be precisely carried out by the above-mentioned operation. However, when total discharge is required in the centrifugal separator, a conduit (22) is formed between the conduit (17) and the end of the lower passage (19) of the sliding valve cylinder. The operation for discharging all of the components from the rotary body will be illustrated. When the pilot sealing ring (18) of the pilot sliding cylinder is opened, the functional fluid in the outer part of the lower passage (19) out of the chain line A is also discharged since the conduit (22) is formed. Accordingly, the centrifugal hydraulic pressure for pushing up the sliding valve cylinder (8) is not applied whereby all of the components in the rotary body are discharged from the outlet (26). The sliding valve cylinder (8) can be pushed up to close the valve sealing ring by feeding the functional fluid into the lower passage (19) of the sliding valve cylinder or ceasing the feed of the functional fluid for opening the valve.

In accordance with the present invention, the centrifugal separator has the structure for maintaining a part of the functional fluid in the lower passage (19) of the sliding valve cylinder whereby the force for closing the sliding valve cylinder (8) is always maintained.

In the conventional centrifugal separator, the sealing water is fed through the feed tube (29). However, in the conventional feature, the sealing water is passed through the passage of the oil whereby an emulsification is caused which is disadvantageous for the separation of oil.

In the case of the partial discharge, the feed of the fuel oil, or the lubricating oil and a dirty oil containing precipitate is not stopped during the discharge of the sludge, therefore feeding the sealing water from the feed tube for feeding the liquid to be treated (mixture) must be avoided.

In accordance with the present invention, the sealing water passage is formed below the separating discs (6) and the sealing water is fed through the sealing water passage to the sludge accumulating part (30), whereby the sealing water is not mixed with the oil and the trouble in the separation of the oil can be prevented.

What is claimed is:

1. In a centrifugal separator for separating components of differing densities, which comprises a rotary body having an outlet at the peripheral part and a sliding valve cylinder which vertically slides in a rotary shell of the rotary body, and a lower passage of the sliding valve cylinder formed between the bottom of the rotary shell and the sliding valve cylinder, and said lower passage being connected to a first functional fluid inlet; an improvement which comprises a conduit which is connected to an inner part of the lower passage of the sliding valve cylinder and which is opened and closed by the movement of a pilot sliding cylinder which is vertically slidably connected under the rotary shell to form an upper passage and a lower passage, said lower passage being shorter than said upper passage, said lower passage and upper passage being connected to a second functional fluid inlet independent from said first functional fluid inlet, and said upper passage being connected to a nozzle, and a valve seal ring positioned for contacting with the peripheral part of the sliding valve cylinder, and a pilot sealing ring positioned for contacting with the peripheral part of the pilot sliding cylinder; whereby the shorter length of the lower space of the pilot sliding cylinder causes said pilot sliding cylinder to move downward due to centrifugal hydraulic pressure when fluid fills both passages by way of said second functional fluid inlet which in turn opens said conduit at said pilot sealing ring thereby releasing the functional fluid in said inner part of said lower passage of said sliding valve cylinder so that said outlet is opened and closed at said valve seal ring by balancing the centrifugal hydraulic pressure caused by the functional fluid maintained in the outer part of said lower passage of said sliding valve cylinder against the centrifugal hydraulic pressure caused by the components fed into the rotary body, whereby the components may be partially discharged.

2. A centrifugal separator according to claim 1 which further comprises a sealing water passage which is formed between a plurality of separating discs and the sliding valve cylinder and which is connected to a sludge accumulating part, and an oil entry passage coaxial with said rotary body, whereby the sealing water passes only adjacent said oil when being discharged during operation of said centrifugal separator.

3. A centrifugal separator according to claim 1 which further comprises a passage connected between the conduit and the end of the lower space of the sliding valve cylinder, thereby permitting complete discharge.

* * * * *